US009574246B2

(12) United States Patent
Nikam et al.

(10) Patent No.: US 9,574,246 B2
(45) Date of Patent: Feb. 21, 2017

(54) TWO ROLLER SUGARCANE CRUSHING MILL

(71) Applicants: Bhausaheb Nikam, Pune (IN); Sachin Nikam, Pune (IN)

(72) Inventors: Bhausaheb Nikam, Pune (IN); Sachin Nikam, Pune (IN)

( * ) Notice: Subject to any disclaimer, the term of this patent is extended or adjusted under 35 U.S.C. 154(b) by 139 days.

(21) Appl. No.: 14/419,598

(22) PCT Filed: Aug. 12, 2013

(86) PCT No.: PCT/IN2013/000489

§ 371 (c)(1),
(2) Date: Feb. 4, 2015

(87) PCT Pub. No.: WO2014/033749

PCT Pub. Date: Mar. 6, 2014

(65) Prior Publication Data

US 2015/0184257 A1 Jul. 2, 2015

(30) Foreign Application Priority Data

Aug. 21, 2012 (IN) ..... 2422/MUM/2012

(51) Int. Cl.

| | |
|---|---|
| ***B02C 4/02*** | (2006.01) |
| ***C13B 10/06*** | (2011.01) |
| ***B02C 4/28*** | (2006.01) |
| ***B02C 4/32*** | (2006.01) |
| ***B02C 4/30*** | (2006.01) |
| ***B02C 4/40*** | (2006.01) |

(52) U.S. Cl.
CPC ..... *C13B 10/06* (2013.01); *B02C 4/02* (2013.01); *B02C 4/286* (2013.01); *B02C 4/30* (2013.01); *B02C 4/32* (2013.01); *B02C 4/40* (2013.01)

(58) Field of Classification Search
CPC ..... C13B 10/06; B02C 2/40; B02C 4/30; B02C 4/32; B02C 4/286; B02C 4/02
See application file for complete search history.

(56) References Cited

FOREIGN PATENT DOCUMENTS

| | | | |
|---|---|---|---|
| CN | 1876263 | A | 12/2006 |
| EP | 1147815 | A2 | 10/2001 |
| GB | 2056878 | A | 3/1981 |
| WO | 02092859 | A1 | 11/2002 |

OTHER PUBLICATIONS

International Search Report for corresponding International Application No. PCT/IN2013/000489.

*Primary Examiner* — Mark Rosenbaum
(74) *Attorney, Agent, or Firm* — Egbert Law Offices, PLLC

(57) ABSTRACT

An improved two roll sugarcane crushing mill with a semi closed frame having a plurality of improved two roll mill modules in tandem. Each improved two roll mill modules has a bottom roll and top roll, the bottom roll being rotatingly mounted in a pair of main frames at the two ends and the top roll is rotatingly mounted in a pair of top beams. One end of each of the top beams being pivotedly attached near the upper end of the main frame towards feed side for swinging the top beams along with the top roll. A hydraulic loader is provided which is pivotally attached between the end of the top beam and the base of the main frame. The semi closed frame fitted at the bottom end to the base of the Head Stock is designed to bear the forces of heavy and fluctuating loads.

19 Claims, 3 Drawing Sheets

TWO ROLLER SUGARCANE CRUSHING MILL

CROSS-REFERENCE TO RELATED U.S. APPLICATIONS

Not applicable.

STATEMENT REGARDING FEDERALLY SPONSORED RESEARCH OR DEVELOPMENT

Not applicable.

NAMES OF PARTIES TO A JOINT RESEARCH AGREEMENT

Not applicable.

REFERENCE TO AN APPENDIX SUBMITTED ON COMPACT DISC

Not applicable.

BACKGROUND OF THE INVENTION

1. Field of the Invention

The present invention relates to an Improved Two Roll Sugarcane-crushing Mill. More particularly this invention relates to the said Improved Two Roller Sugarcane crushing Mill having a semi closed frame invented for operational convenience sturdiness and improved performance.

2. Description of Related Art Including Information Disclosed Under 37 CFR 1.97 and 37 CFR 1.98.

In the prior art, the inventor of the present invention has fully described and claimed an improved two roller sugarcane crushing mill in his Indian patent No. 186646. Several corresponding foreign patents in countries like US, South Africa, ARIPO etc. also have been granted. The two roller crushing mill claimed in the said patent had distinct advantages as enumerated in the specification of the said patent over the earlier crushing mills. In the said mill a single or plurality of feeder rollers of toothed or Cast iron type are used, without needing a closed stationary pressure chute for compressed/compact feeding of prepared cane/bagasse mat and in which, pivoted hydraulic system attached to a lever arm for free floating top roll is provided to give more loading at less hydraulic pressure and at the same time easy dismantling of top rolls, and reduced hydraulic seal failure resulting into low maintenance cost, less power consumption and improved performance, as of existing mill.

Although the said two roller mill claimed in the said patent by the same inventor had distinct advantages, during installation and its working it was observed that, it had following limitations which needed to be improved.

1. There was further scope to strengthen the headstock frame in the said mill.
2. There was further scope for better arrangement for side supporting of the Bottom roll Bearing.
3. Provision of better locking arrangement for the Bottom roll Bearing with bolting arrangement was desired.
4. Provisions were necessary for easy assembly/dismantling of Bottom roll without removing the Top roll.
5. Taper wedges needed to be eliminated for providing strength and reducing stresses in the headstock frame and convenience for operation as well as maintenance
6. Provision of imbibition or maceration liquid feeding means was required on the scraper for feeding the imbibition/maceration liquid to the bagasse mat for increased extraction efficiency.
7. Forcing zig-zag travel of the bagasse mat for providing better permeability for improved extraction efficiency.

BRIEF SUMMARY OF THE INVENTION

The main object of this invention is to obviate the above mentioned limitations of the two roll sugarcane crushing mill claimed in 186646 patent by providing a novel specially designed semi closed frame to bear the Forces of heavy and fluctuating loads is provided at the bottom end to the base of the Head Stock Main Frame by means of a Pin and bush arrangement or any other means. At the top end the Member is fixed with the Head Stock by means of one or plurality of Pin and Bush arrangement(s) or any other means.

The two roller mill with semi closed frame of the present invention provides for changing orientation of the bagasse mat travel path to counter balance and effective use of the sugarcane load. It provides more drainage locations resulting in higher extraction efficiency. Provision of more drainage locations also results in reduction of juice load on the main rollers and would result in more power saving.

In addition to the novel semi closed frame (39) provided by the present invention, all the claimed features of the two roller mill in patent No. 186646 are also incorporated in the new invention.

BRIEF DESCRIPTION OF THE DRAWINGS

FIGS. 3A to 3C show the conventional and improved two roller crushing mill of patent 186646, wherein FIG. 3A shows conventional two roller mill, and FIGS. 3B and 3C describe the improved two roller sugar cane crushing mill.

Table-1 hereinbelow describes in details the legends with corresponding components of the two roller mill along with the semi closed frame.

TABLE 1

Figure 1:
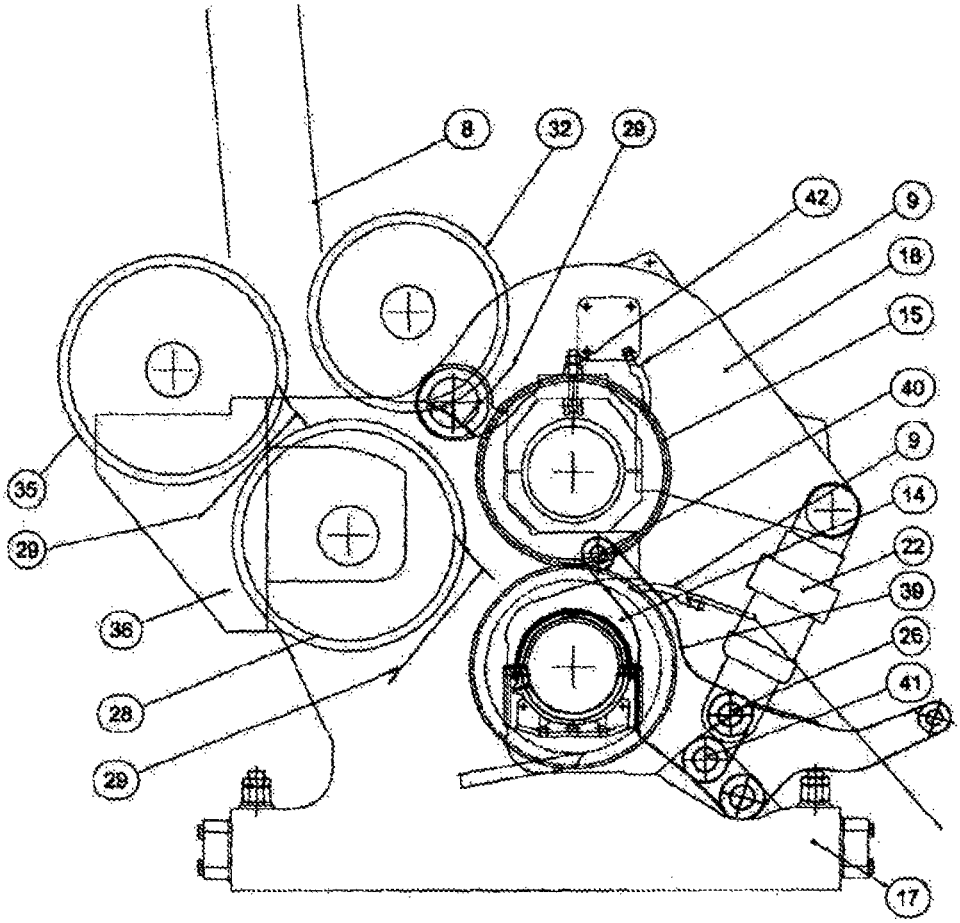
FIG. 1 describes the arrangement and placing of the novel semi closed frame (39) of the present invention along with the two roller mill of the 186646 patent.
Figure 2:
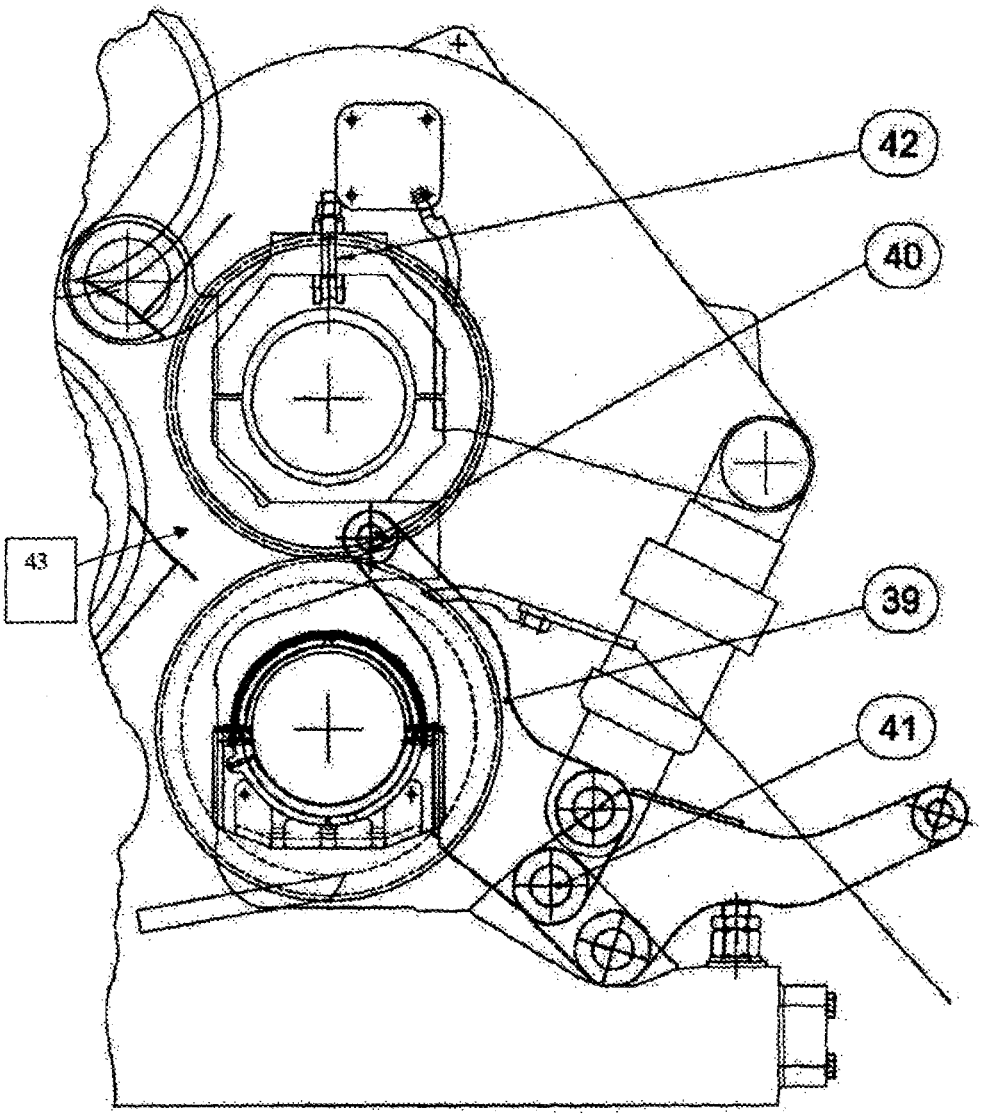
FIG. 2 describes the novel semi closed frame in details.
Figure 3B:
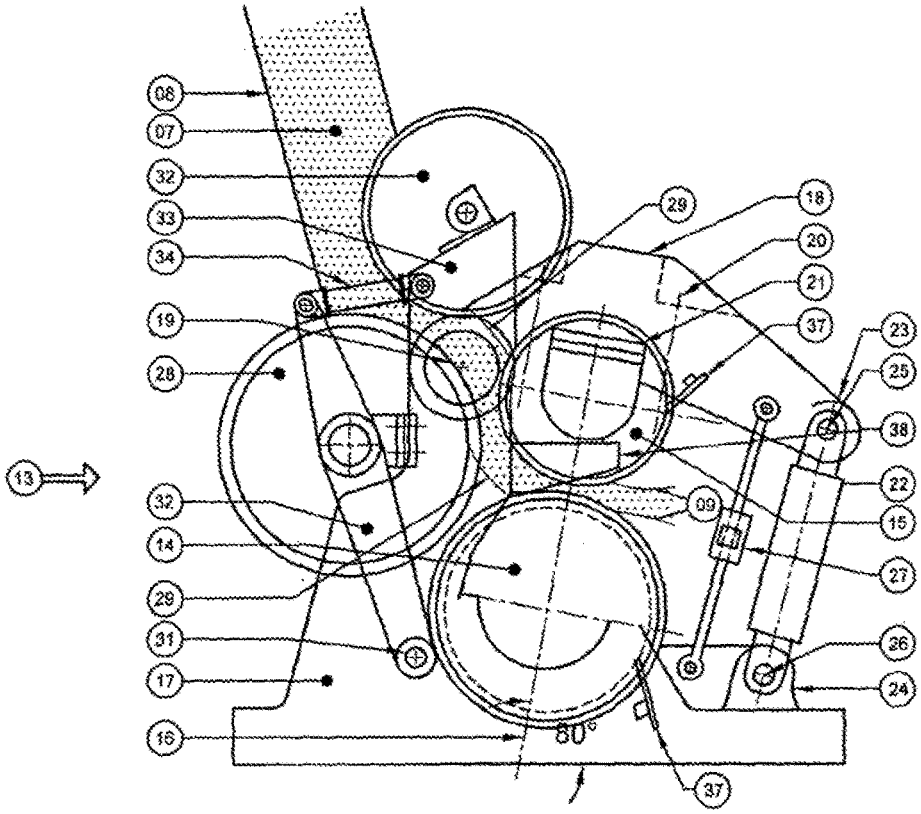
Figure 3A:
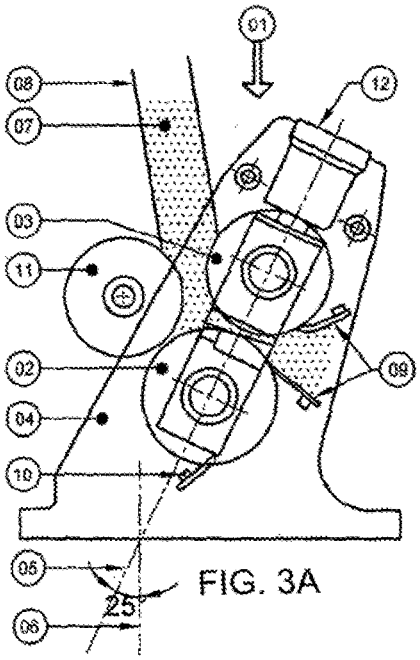
Figure 3C:
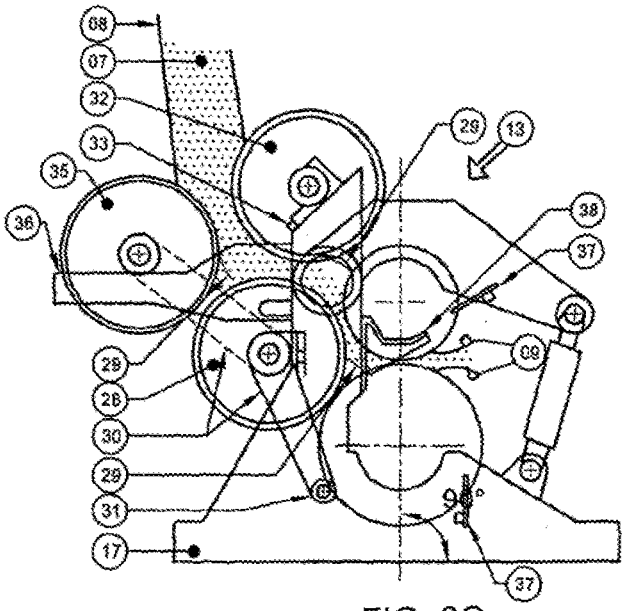

| Legend No. | DESCRIPTION |
|---|---|
| | FIG. 3A |
| 1 | Two Roller Mill Module |
| 2 | Bottom Roll |
| 3 | Top Roll |
| 4 | Head Stocks paid (L.H. & R.H.) |
| 5 | Central Axis of Top And Bottom Roll |
| 6 | Vertical Axis |
| 7 | Feed of Prepared Bagasse |
| 8 | Donnelly Chute |
| 9 | Scrapers |
| 10 | Scraper Cum Knife |
| 11 | Grooved Under Feed Roller |
| 12 | Hydraulic Loading Means |
| | FIGS. 1, 2, 3B and 3C |
| 13 | Two Roller Mill Module |
| 14 | Bottom roll |
| 15 | Top roll |
| 16 | Central Axis of Mill Rollers |
| 17 | Head Stocks Pair (LH. & RH) |
| 18 | Lever Arms Pair (LH. & RH) |
| 19 | Pivot Pin |
| 20 | Top roll Bearing Holding Bolts (4 × 2) |
| 21 | Flexible Bolt |

TABLE 1-continued

| Legend No. | DESCRIPTION |
|---|---|
| 22 | Hydraulic Cylinder |
| 23 | End of Top Beam (Lever) (LH & RH) |
| 24 | Base of Main Frame (Headstocks) (LH & RH) |
| 25 | Pivot Pin for Hydraulic Cylinder |
| 26 | Pivot Pin for Hydraulic Cylinder |
| 27 | Tie Rod |
| 28 | Feed Roller |
| 29 | Scraper Cum Deflector |
| 30 | Auxiliary Frame |
| 31 | Auxiliary Frame Pivot |
| 32 | Second Feeder Roller |
| 33 | Second Feeder Roller Bracket (Pair) |
| 34 | Hydraulic Cylinders (Pair) |
| 35 | Third Feeder Roller |
| 36 | Third Feeder Roller Bracket |
| 37 | Messacheart Knives |
| 38 | Wedge Figure (1) and (2) |
| 39 | Side Caps (Pair) |
| 40 | Side Caps (Pair) Pin at Top End |
| 41 | Side Caps (Pair) Pin at Bottom End |
| 42 | Top roll Bearing Holding Suspender |
| 43 | Imbibition liquid feeding means |

DETAILED DESCRIPTION OF THE INVENTION

Referring to FIGS. 3A and 3B, the improved two roll sugarcane crushing mill with a semi closed frame comprises a plurality of improved two roll mill modules in tandem, each of the said improved two roll mill modules comprising a pair of main crushing rolls consisting of a bottom roll (14) and top roll (15), the said bottom roll (14) being rotatingly mounted in a pair of main frames (17) at the two ends, the said top roll (15) being rotatingly mounted in a pair of top beams/lever arms/swing arm (18), one end of each of the said top beams (18), being pivotedly attached near the upper end of the head stock (17) towards feed side for swinging the said top beams along with the top roll (15), a hydraulic loading means (12) pivotally attached between the end of the said top beam (18) and the base of the main frame (17), at least one feeder roller optionally with a scrapper cum deflector with juice drainage means (29) provided in the close proximity of the said main crushing rolls (14 and 15), the said feeder roller being mounted on an auxiliary frame (30) and the said auxiliary frame being rigidly or pivotally mounted preferably on the said main frame (17) for swingably adjusting the loading and setting the said feeder roller (28) in desired position, a semi closed frame (39) designed to bear the forces of heavy and fluctuating loads, which is fitted at the bottom end to the base of the Head Stock Main Frame (17) by means of a Pin and bush arrangement (41), at the top end the frame (39) is fixed with the Head Stock frame (17) by means of one or two Pin and Bush or any other arrangement (40).

In one of the embodiments of the present invention the central axis of the said top roll (15) and bottom roll (14) may either vertical or having an angle up to 20° on either side of the vertical axis.

In another embodiment the ratio of diameter of the said bottom roll (14) to the top roll (15) diameter may be between 1:1 to 1:0.90

In still another embodiment the auxiliary frame (30) is rigidly or pivotedly mounted on a separate base adjacent to the said main frame (17).

In yet another embodiment the said top beam (18), at its free end adjacent to the hydraulic loading means (22) is additionally provided with a mechanical holding means (27) connected in between the said base of the main frame (17) and the said top beam (18), for holding the top roll (15) in pressed/operating position in case hydraulic loading means (22) goes out of order or becomes defective.

In yet another embodiment the top and bottom rolls (14, 15) are provided with any type of grooves on its peripheral surface and either one or both are having perforations forming lotus roll(s) in a conventional manner.

In still another embodiment either one or both of the said top and bottom crushing rolls is/are provided with messacheart grooves and knives (37) in conventionally known manner.

In still another embodiment the feeder roller (28) provided for compacting the cane/bagasse mat are two in number and the said second feeder roller (32) is mounted, at each end, on the top of the said main frame/headstock (17). In yet another embodiment the auxiliary frame (30) and the said main frame (17) are flexibly interconnected, near the upper ends, with the help of hydraulic means (34) for variably adjusting the gap between the feeder rollers and/or between the feeder roller and main crushing rolls.

In another embodiment the said main frame (17) and the third feeder roller are rigidly inter connected near the upper ends with the help of known mechanical means (30) for maintaining a desired setting of the said rollers. In yet another embodiment the said feeder rollers (28, 32, 35) provided for compacting the cane/bagasse mat are three in number and the said third feeder roller (35) is mounted, at each end, on the said auxiliary frame (30) above the said first feeder roller (28).

In still another embodiment the third feeder roller (35) is mounted, at each end on a protrusion/bracket, either formed integrally, or fixed otherwise in a known manner, with the main frames (17) and the bearings of the third roller feeder are slidable in the slots formed in said protrusion for adjusting the gap between the feeder rollers (28, 32, 35).

In yet another embodiment the feeder rollers (28, 32, 35) are grooved roller(s) or grooved perforated roller(s) (lotus) or toothed roller(s) or toothed perforated roller(s) or any combination of those rollers.

In still another embodiment each of the said feeder roller (28, 32, 35) is positioned as under feeder roller is provided with a scraper-cum-deflector (29) while the said feeder roller positioned as over feeder roller may or may not be provided with scrapper-cum-deflector.

In another embodiment the first module in the tandem of existing three roll mill may be improved two roll mill module, for squeezing out the maximum possible moisture from the bagasse and to improve primary extraction and also to facilitate recirculation of secondary juice for improving the extraction further.

In another embodiment the last module in tandem of existing three roll mill may be improved two roll mill module, for squeezing out the maximum possible moisture from the bagasse thereby improving its calorific value, the said bagasse when used in boilers as fuel increases its efficiency.

In one of the embodiments of the present invention the Hydraulic Cylinder (22) is positioned on the bottom end of frame (39) for the sake of ease of maintenance.

In yet another embodiment the frame (39) is able to swing back on removing the top pin (40) and facilitate easy and convenient removal of the Bottom roll (14) for maintenance of the said arrangement allowing such dismantling without the need to remove the Top roll (15) as was required in the previous arrangement.

In still another embodiment the semi closed frame (39) may be of any shape, exemplified by but not limited to a cap or rod.

In yet another embodiment the scrapers (29) provided on feeder roller (28) and feeder roller (32) may be provided with an imbibition or maceration liquid feeding means (43) for feeding the imbibition/maceration liquid to the bagasse.

Advantages of the Present Invention

The improved two roller sugarcane crushing mill with the novel semi closed frame provides following advantages:

1. It strengthens the Headstock Frame.
2. Provides better arrangement for side supporting of the Bottom roll Bearing.
3. It provides for better locking arrangement for the Bottom roll Bearing with bolting arrangement.
4. The new improved two roller mill provides easy assembly/dismantling of Bottom roll without removing of the Top roll.
5. It eliminates the taper wedges as above and in the process providing strength and convenience for operation as well as maintenance.
6. The top roll holding arrangement needs only two bolts as compared to 4 in the earlier mill without affecting the strength.
7. Provision of imbibition or maceration liquid feeding means on the scraper for^ feeding the imbibition/maceration liquid to the bagasse results, in increased extraction efficiency.
8. Provides improved permeability for easy extraction of juice.
9. Reduced juice load on the mill rollers.

We claim:

1. A sugar cane crushing mill comprising:

a plurality of two-roll mill modules arranged in tandem, each of said plurality of two-roll mill modules comprising:

a pair of main crushing rolls each having a bottom roll and a top roll;

a pair of main frames to which the bottom rolls are rotatingly mounted at respective opposite ends of the bottom roll;

a pair of top beams to which the top rolls rotatingly mounted at respective opposite ends of the top rolls, one end of each of said pair of top beams being pivotally attached adjacent an upper end of said pair of main frames toward a feed side such that said pair of top beams and top roll can swing;

a hydraulic loader pivotally attached between one of the opposite ends of said top roll and a base of said pair of main frames;

at least one feeder roller with a scraper cum deflector having a juice drainer in proximity to said pair of main crushing rolls;

an auxiliary frame to which said at least one feeder roller is mounted, said auxiliary frame being rigidly or pivotally mounted on said pair of main frames so as to swingably adjust a loading and a setting of said at least one feeder roller in a desired position;

a semi-closed frame adapted to bear forces of heavy or fluctuating loads, said semi-closed frame being fitted at a bottom end thereof to a base of said pair of main frame by a pin-and-bush arrangement, said semi-closed frame having a top end that is fixed to said pair of main frames.

2. The sugarcane crushing mill of claim 1, wherein a central axis of the top roll and the bottom roll is either vertical or has an angle up to 20° on either side of vertical.

3. The sugarcane crushing mill of claim 1, wherein a ratio of a diameter of the bottom roll to a diameter of the top roll is 1:1 to 1:0.90.

4. The sugarcane crushing mill of claim 1, wherein said auxiliary frame is rigidly or pivotably mounted on a separate base adjacent to said pair of main frames.

5. The sugarcane crushing mill of claim 1, wherein a free end of the top beam adjacent to the hydraulic loader has a mechanical holder connected between the base of the main frame and the top beam for holding the top roll in a position in an event in which the hydraulic loader goes out of order or becomes defective.

6. The sugarcane crushing mill of claim 1, wherein the top and bottom rolls have a groove on a peripheral surface thereof, at least one of the top and bottom rolls having perforations forming a lotus roll.

7. The sugarcane crushing mill of claim 1, wherein at least one of the top and bottom crushing rolls have messacheart grooves and knives.

8. The sugarcane crushing mill of claim 1, wherein said at least one feeder roller comprises a first feeder roller and a second feeder roller, said second feeder roller being mounted at each end on the top of the said pair of frames.

9. The sugarcane crushing mill of claim 1, wherein said auxiliary frame and said pair of main frames are flexibly interconnected near upper ends thereof by an hydraulic actuator to variably adjust a gap between said first and second feeder rollers or between one of said first and second feeder rollers and said pair of main crushing rolls.

10. The sugarcane crushing mill of claim 1, wherein said pair of main frames and a third feeder roller are rigidly interconnected near upper ends thereof by a mechanical connector.

11. The sugarcane crushing mill of claim 1, wherein said feeder rollers compact a cane/bagasse mat, a third feeder roller is mounted at each end on said auxiliary frame above said first feeder roller.

12. The sugarcane crushing mill of claim 1, wherein a third feeder roller is mounted at each end on a protrusion or bracket, either formed integrally with or fixed with said pair of main frames, said third feeder roller having bearings that are slidable in a slot formed in the protrusion for adjusting the gap between the feeder rollers.

13. The sugarcane crushing mill of claim 12, wherein the feeder rollers are selected from the group consisting of grooved rollers, grooved perforated rollers, toothed rollers, toothed perforated rollers, and combinations thereof.

14. The sugarcane crushing mill of claim 13, wherein at least one feeder roller comprises an under feeder roller having a scraper-cum-deflector and an over feeder roller.

15. The sugarcane crushing mill of claim 1, wherein a last module of the mill module adapted to squeeze moisture from bagasse so as to improve calorific value of the squeezed bagasse.

16. The sugarcane crushing mill of claim 1, further comprising:

a hydraulic cylinder positioned at a bottom of said semi-closed frame.

17. The sugarcane crushing mill of claim 1, wherein said semi-closed frame is able to swing back upon removing a top pin connected thereto.

18. The sugarcane crushing mill of claim 1, wherein said semi closed frame having a shape of a cap or a rod.

19. The sugarcane crushing mill of claim 1, wherein the scrapers provided on the feeder roller has an imbibition or maceration liquid feeder so as to feed the imbibition or maceration liquid to the bagasse.

* * * * *